United States Patent [19]

Bergman et al.

[11] Patent Number: 4,778,518

[45] Date of Patent: Oct. 18, 1988

[54] SLAG-MELT REACTIONS WITH IMPROVED EFFICIENCY

[75] Inventors: Kjell Bergman; Göran Grimfjärd; Thore Gustafson; Lars Karlsson, all of Västerås, Sweden

[73] Assignee: ASEA AB, Västerås, Sweden

[21] Appl. No.: 943,929

[22] Filed: Dec. 18, 1986

[30] Foreign Application Priority Data

Dec. 20, 1985 [SE] Sweden ..... 8506060

[51] Int. Cl.[4] ..... C22B 4/00

[52] U.S. Cl. ..... 75/10.16; 266/234

[58] Field of Search ..... 75/10.16; 266/234

[56] References Cited

U.S. PATENT DOCUMENTS 3,704,476 1/1973 Hammarlund et al. ..... 266/234

FOREIGN PATENT DOCUMENTS 435286 7/1975 U.S.S.R. ..... 266/234

523605 7/1940 United Kingdom ..... 75/10.16

*Primary Examiner*—Melvyn J. Andrews

*Attorney, Agent, or Firm*—Kenyon & Kenyon

[57] ABSTRACT

A method and a device for improving the efficiency of slag-bath reactions, for example in connection with sulfur removal from steel melts, involves stirring the melt with at least one inductive stirrer in such a way that the stirring force includes both a horizontal and a vertical component.

5 Claims, 1 Drawing Sheet

SLAG-MELT REACTIONS WITH IMPROVED EFFICIENCY

TECHNICAL FIELD

The present invention relates to a method of improving the efficiency of reactions between slag and melt in a bath of molten metal, for example in the case of reactions to reduce the sulfur content of a steel melt, in which stirring of the melt is performed using at least one inductive stirrer. The invention also relates to a device for carrying out the method.

One aim in connection with reactions of the above-mentioned kind is the desire for increasingly shorter treatment times. One object of the present invention is thus to improve the slag-metal interfacial contact, primarily in order to accelerate and improve the refining action of the bath, for example sulfur removal from the metal bath.

BRIEF SUMMARY OF THE INVENTION

The method according to the invention is characterized in that the stirring is performed by generating a stirring force having a vector composed of horizontal and vertical components. Rotary as well as vertical stirring of the melt thus take place, improving the intensity of slag stirring and in this way accelerating the transport of "fresh" slag to the reaction zone in the bath.

The method of the invention can be operated, for example, with two stirrers (e.g. one acting vertically and one acting horizontally) or with just one stirrer acting obliquely.

In a preferred embodiment of the method of the invention a lance is immersed into the melt to a depth of 0–1000 mm below the slag surface and an inert gas is blown through the lance in the course of the stirring. Gas injection increases the intensity of mixing between the slag and the melt. By keeping a short depth of immersion of the lance, the cost of the lance can be kept low. This is also made possible by water-cooling that part of the lance which is located above the slag surface and by making the lower part of a replaceable refractory material (e.g. a ceramic material).

It is also possible to use two or more stirrers, located adjacent each other or at peripherally separated portions of the bath-containing vessel (e.g. a furnace or ladle), the stirrers being individually controlled as regards the current/frequency of their energising supply for achieving different stirring forces. This arrangement increases the turbulence, which is again advantageous since it accelerates refining reactions.

In its device aspect, the invention is characterized in that the at least one stirrer is arranged such that the vector of the stirring force created in the melt includes both horizontal and vertical components.

BRIEF DESCRIPTION OF THE DRAWING

The method and the device according to the invention are exemplified in greater detail, by way of example, in the accompanying drawing, wherein.

DESCRIPTION OF PREFERRED EMBODIMENTS

Figure 1:
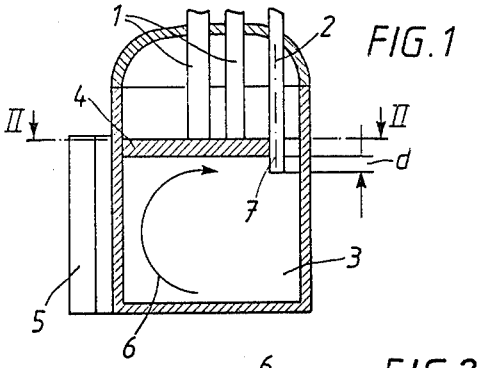
FIG. 1 shows a ladle furnace in accordance with the invention with an immersed lance.
Figure 2:
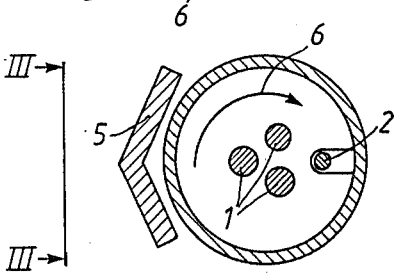
FIG. 2 is a horizontal section on the line II—II in FIG. 1.

FIG. 1 shows a ladle furnace or other furnace with arcing electrodes 1, for example three-phase electrodes and containing melt 3 with a slag layer 4. The numeral 2 designates an immersion lance, which is immersed 0–1000 mm below the lower surface of the slag layer 4 of the melt 3. (See also FIG. 2.) Numeral 5 designates an inductive, multiphase stirrer, which is mounted to one side of the furnace and has an upward stirring direction (see the arrow 6). This stirring direction can be varied.

Figure 3:
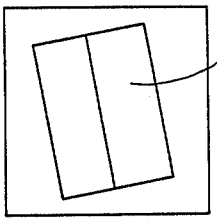
FIG. 3 is a view of the lower part of the furnace in the direction of the arrows III—III in FIG. 2.

The method, which can be performed by means of this device, comprises intensifying the mixing rate between the slag layer 4 and the melt 3 by means of gas bubbling in combination with inductive stirring of the metal melt by means of the stirrer 5, gas entering the lance 2 from above and exiting into the melt 3 at the distance d below the lower surface of the slag layer 4. The gas is suitably an inert gas and that part of the lance 2 which is located above the slag layer is suitably provided with cooling means (e.g. channels for water to flow therethrough). The lower part 7 of the lance 2 can be replaceable and can be made of a ceramic or other refractory material. The inductive stirring is arranged such that a rotary movement is imparted to the slag in the layer 4 and the melt 3 while at the same time a vertical bulk stirring is obtained in the melt 3, for example by placing the stirrer 5 in an inclined position (as shown in FIG. 3) or adjusting it in some other way (described below). By the oblique positioning of the stirrer 5, the travelling field generated has one component in the horizontal direction and one in the vertical direction, which produces the rotary movement mentioned above. Because the slag in the layer 4 rotates, the slag is continuously renewed in the reaction region. Because of the limited depth of immersion of the lance 2 and the provision of water or other cooling of the upper part of the lance 2, the initial and replacement costs of the lance 2 can be kept low. The method can be carried our during simultaneous heating of the melt 3 by means of the electrodes 1.

Instead of the lance 2 being hollow to allow gas injection into the melt to improve turbulence, it can be a solid rod of refractory material (e.g. a ceramic rod) which when immersed into the melt 3 disturbs the fluid flow pattern and thereby increases the turbulence in the melt as well as the mass transfer between the slag and the melt.

Figure 4:
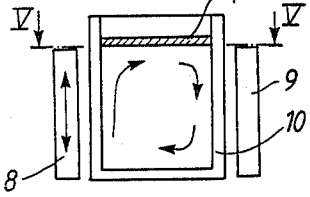
FIG. 4 shows a second embodiment of ladle according to the invention having two stirrers.
Figure 5:
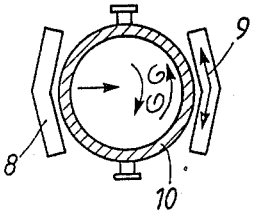
FIG. 5 shows a horizontal section of the ladle of FIG. 4 on the line V—V.

FIGS. 4 and 5 show a device with two stirrers, namely, one vertical stirrer 8 and one horizontal stirrer 9, which are located on opposite sides of a ladle or furnace 10. The two components for the travelling field used for melt stirring are obtained by the combined efect of the two stirrers 8, 9.

The device shown in FIGS. 4 and 5 can be employed, for example, as follows.

The melt is stirred by the combination of the two inductive stirrers 8, 9, one stirrer 8 moving the melt substantially in a vertical direction and the other stirrer 9 moving the melt in a horizontal (radial) direction. With the horizontal (radial) stirrer 9, the stirring direction can be changed intermittently (see FIGS. 6*a* and 6*b*), which results in the formation of eddies. In combination with the superimposed downwards directed flow, caused by the vertical stirrer 8, the eddy formation causes slag particles from the layer 4 to be drawn down into the melt. The change of direction may take place at a frequency ranging from about 0.5 to about 0.05 times per second. The frequency can also be varied temporarily for the radial stirrer 9, in order to change the depth of penetration and hence the distribution of power. Similar changes of direction can also take place in the case of the vertical stirrer 8.

Figure 6A:
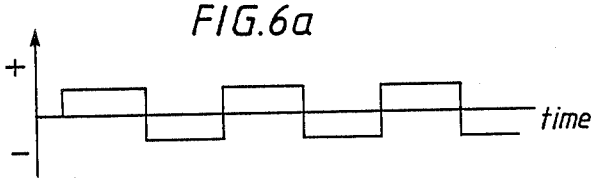
FIGS. 6*a* and 6*b* show examples of stirring patterns for the device according to FIGS. 4–5.
Figure 6B:
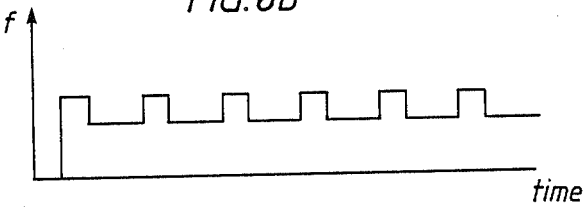

One aim of the device shown in FIGS. 4–6 is also to improve the slag-bath mass transfer, thus achieving improved melt refining. In FIG. 6*a* the x-axis represents time and the y-axis the polarity of the horizontal stirrer 9, whereas FIG. 6*b* shows the change of the frequency f (ordinate) of the same stirrer using another stirring variant.

Figure 7:
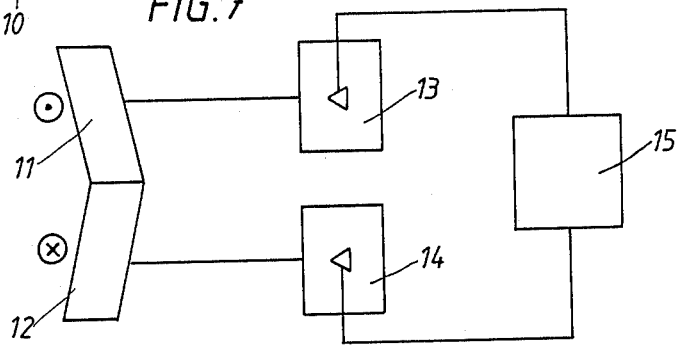
FIG. 7 shows, schematically, an alternative two-stirrer device according to the invention.

FIG. 7 shows a device in which the stirrer is divided into two halves 11, 12, each being fed separately from an individual thyristor power supply unit 13, 14. This arrangement provides a possibility of controlling the two parts individually by means of a control device 15 with respect to current amplitude, direction and frequency. Program control of the device 5 is clearly possible allowing wide variations in stirring pattern to be obtained during a refining process.

By using the device shown in FIG. 7, the possibilities of increased turbulence are great and since these can lead to a more tubulent bath surface, they can advantageously affect the speed and efficiency of available slag-bath reactions.

The methods and the devices described above with reference to the drawings can be varied in many ways within the scope of the following claims.

What is claimed is:

1. A method for reacting a melt of molten metal with a layer of slag on the melt, comprising inductively stirring the melt simultaneously both substantially vertically and substantially horizontally by stirring force.

2. The method of claim 1 in which the melt is so inductively stirred with one substantially vertical stirring force and simultaneously inductively by one substantially horizontal stirring force and which is other than the first-named stirring force.

3. The method of claim 2 in which at least one of the stirring forces is periodically reversed in its stirring direction.

4. The method of claim 1 in which a flow obstruction is immersed in the melt a distance of not more than 1000 mm below the layer of slag.

5. The method of claim 4 in which an inert gas is blown into the melt at the bottom of the obstruction.

* * * * *